US005628716A

United States Patent [19]

Brice

[11] Patent Number: 5,628,716

[45] Date of Patent: May 13, 1997

[54] ADJUSTABLE WEIGHT EXERCISE DEVICE

[76] Inventor: John P. Brice, 14229 Ivy St., Adelanto, Calif. 92301

[21] Appl. No.: 577,818

[22] Filed: Dec. 22, 1995

[51] Int. Cl.[6] ..... A63B 21/072

[52] U.S. Cl. ..... 482/106; 482/108; 482/107; 482/98

[58] Field of Search ..... 482/92, 93, 98, 482/106–109, 104

[56] References Cited

U.S. PATENT DOCUMENTS

| | | | |
|---|---|---|---|
| 48,514 | 7/1865 | Butler | 482/108 |
| 1,536,048 | 5/1925 | Alastalo | 482/108 |
| 1,672,944 | 6/1928 | Jowett | 482/108 |
| 2,676,802 | 4/1954 | O'Brien | 482/106 |
| 4,529,197 | 7/1985 | Gogarty | 482/108 |
| 4,566,690 | 1/1986 | Schook | 482/108 |
| 4,880,229 | 11/1989 | Broussard | 482/108 |
| 5,090,693 | 2/1992 | Liang | 482/108 |
| 5,171,199 | 12/1992 | Panagos | 482/106 |
| 5,221,244 | 6/1993 | Doss . | |
| 5,256,121 | 10/1993 | Brotman . | |
| 5,407,413 | 4/1995 | Kupferman | 482/108 |

FOREIGN PATENT DOCUMENTS

| | | | |
|---|---|---|---|
| 812677 | 5/1937 | France | 482/108 |
| 18336 | of 1890 | United Kingdom | 482/108 |
| 2135894 | 9/1984 | United Kingdom | 482/108 |

*Primary Examiner*—Lynne A. Reichard
*Assistant Examiner*—Victor K. Hwang
*Attorney, Agent, or Firm*—Don B. Finkelstein

[57] ABSTRACT

A body building or therapy adjustable weight exercise device for use in strengthening hands, arms, chests and neck of a person using the same, wherein it is either a barbell or dumbbell including a central bar section to be gripped by a hand or hands with equal poundage weights at each end of the bar, and weights holding-locking means to affix the weights to the central bar and auxiliary disk weights capable of being removably mounted on the holding-locking means to alter the total weight of the device.

11 Claims, 2 Drawing Sheets

ADJUSTABLE WEIGHT EXERCISE DEVICE

BACKGROUND OF THE INVENTION

1. Field of the Invention.

This invention relates to an adjustable weight exercise device used in weight lifting, body building or physical therapy and rehabilitation utilizing auxiliary weights.

2. Description of the Prior Art.

Heretofore attempts to add weight to exercise device have required the keying of one weight to another to interlock them for use such as disclosed in U.S. Pat. No. 5,221,244 ('244) to Doss. This has the disadvantage of requiring the person making the addition to take the time to make sure the weight pieces are interlocked. Also in the '244 patent with the threaded bore of the auxiliary or extra weight there can be a projection that extends beyond the weight that could catch on something or it could cause injury to a person.

In addition, the prior art has included added weights to exercise device such as barbells and dumbbells which are magnetically attached to the device, such as found in U.S. Pat. No. 5,256,121 ('121) to Brotman. Such device has the disadvantage and deficiency of the weights becoming dislodged and falling during use which may cause injury.

SUMMARY OF THE INVENTION

As used throughout the specification and claims "exercise device" shall refer to dumbbells or barbells where each have a center bar for gripping by a hand or hands with a weight juxtaposed each end of the center bar and the exercise device is for lifting.

It is the purpose of the present invention to provide exercise device that is capable of having auxiliary weights added thereto in a quick, convenient and safe manner.

Another object of the present invention is to provide a conventional dumbbell or barbell with a center bar and a pair of disk weights secured on the ends of the center bar, and each weight includes a threaded centrally spaced collar projecting outwardly of the disk to threadably receive auxiliary weights.

A yet further object of the present invention is to provide a set screw to retain the threaded collar to an existing disk weight and center bar for holding an auxiliary weight.

Another object of the present invention is to provide a conventional dumbbell or barbell wherein the added weights are only partially threaded through their thickness so that when positioned on the threaded collar, the collar will not project through the auxiliary weight.

These and other objects and advantages will become apparent from the following part of the specification wherein details have been described for the competence of disclosure, without intending to limit the scope of the invention which is setforth in the appended claims.

BRIEF DESCRIPTION OF THE DRAWINGS

These advantages may be more clearly understood from the following description and by reference to the drawings in which.

DETAILED DESCRIPTION OF THE PREFERRED EMBODIMENT

Figure 1:
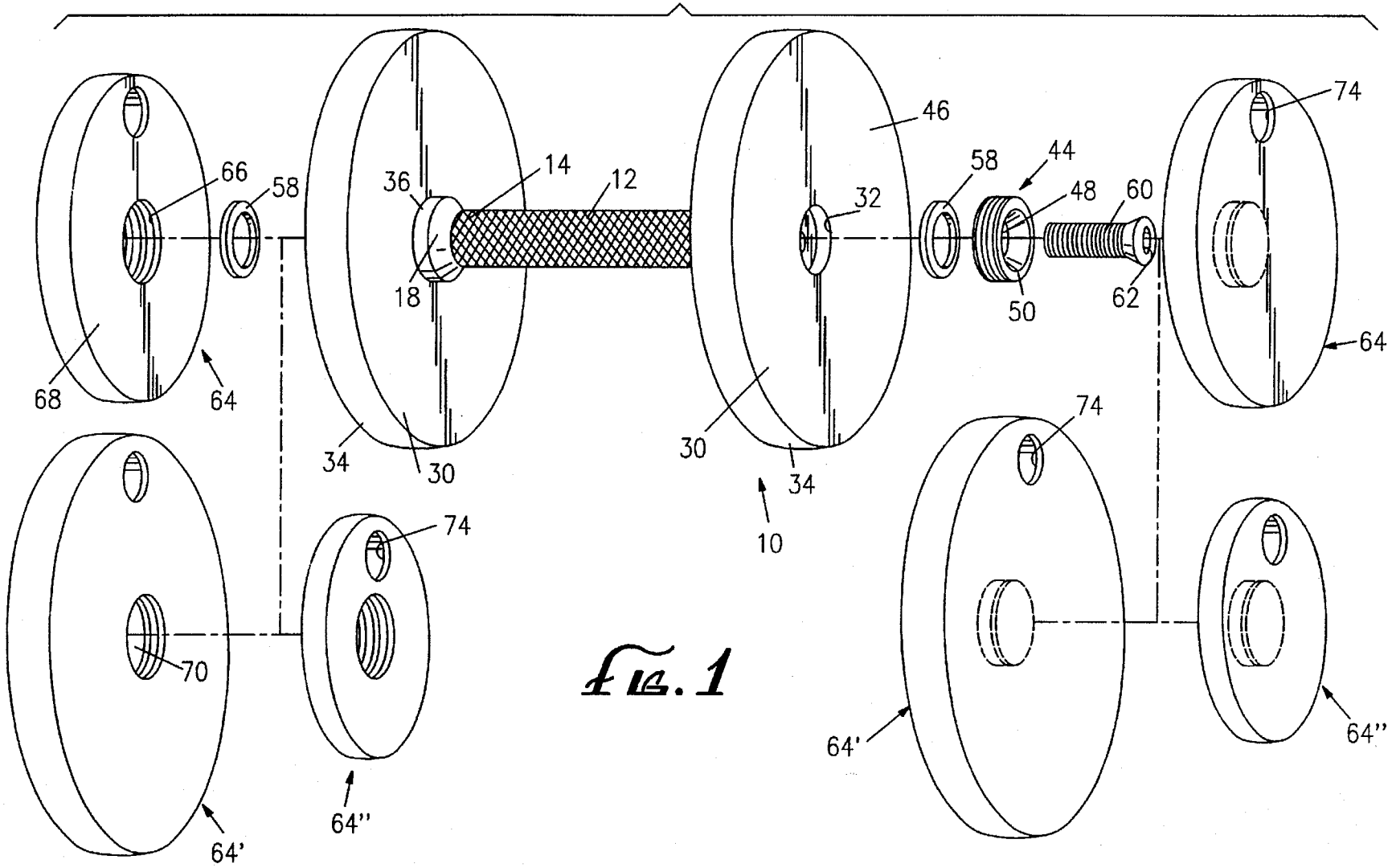
FIG. 1 is an exploded view of the adjustable weight exercise device forming a part of the present invention showing that disks of differing weights may be added.

The drawings illustrate an adjustable weight exercise device generally designated 10 which preferably may be either a barbell or a dumbbell. For the purpose of this application either "barbell" or "dumbbell" shall be interchangeable terms with adjustable weight exercise device.

The device 10 includes a central annular bar 12 that is preferably knurled to assure a proper hand grip for lifting the barbell or dumbbell 10. Each end 14 and 16 of bar 12 is flared outwardly forming annular stops 18 and 20. Each stop includes an annular stop flange 22 and an annular shank portion 24.

Extending inwardly from end 26 (FIG. 2) through the shank 24 into the bar 12 is a thread bore 28, the purpose of which will be described.

Mounted on the shank 24 of each annular stop 18 and 20 are disk weights 30. These are conventional weights that include a center bore 32 and they are preferably annular with rounded annular edges 34. Each disk 30 is equal in weight.

In order to mount the disk weights 30 on the central bar 12, preferably rubber washer 36 (FIG. 1 and 2) is placed over the shank 24 and the weight bore 32 slides over the shank 24 and abuts the washer 36. This will help to lock the weights in place.

Figure 2:
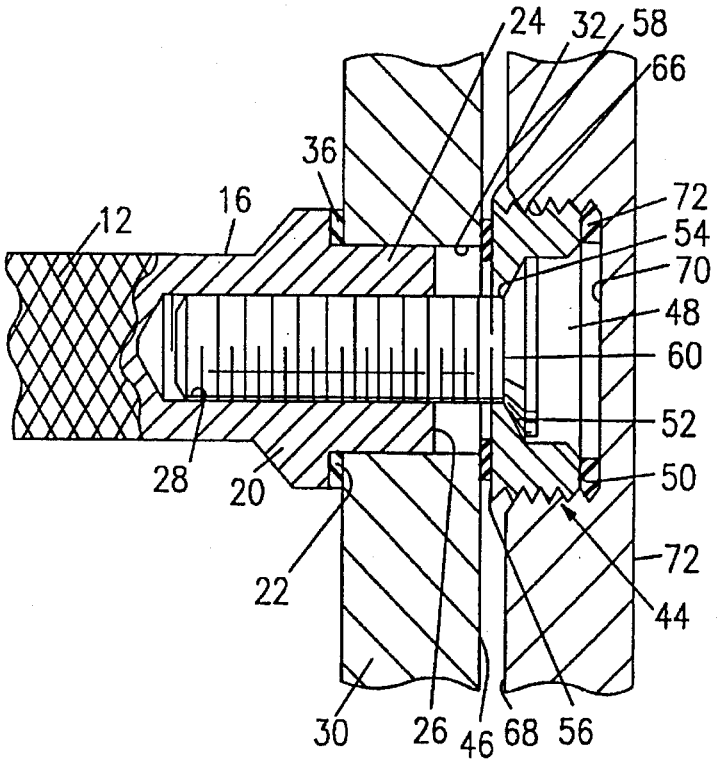
FIG. 2 is a cross sectional elevational view of the present invention showing one end assembled with an auxiliary weight in position.
Figure 3:
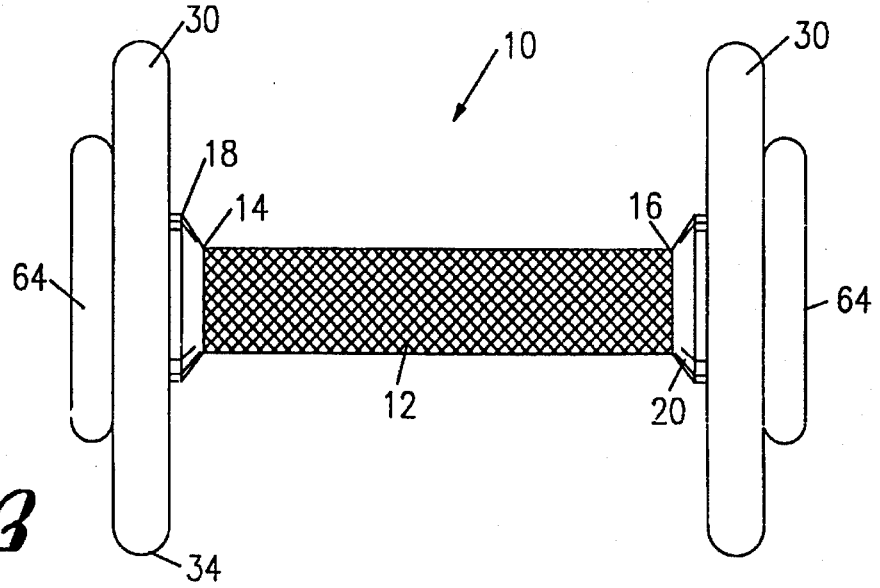
FIG. 3 is a front elevational view of the present invention fitted with auxiliary weight disks ready for use.

Part of the invention resides in the weight locking-holding means or collar designated 44 that abuts the outer face 46 of disks 30. The weight locking-holding means 44 is annular and includes a recess 48 that extends inwardly from outer face 50. It has a tapered inner face 52 as best seen in FIG. 2, and includes a bore 54 that extends through an inner face 56 of the means Optionally, a washer 58 may be placed between the disk weight 30 and the locking holding means 44.

In order to both lock the disk weight 30 to the central bar 12 and to secure the collar 44 to the face 46 of the weight 30 a set screw 60 passes into the collar 44 and is threaded into bore 28 by any conventional means, such as an Allen wrench and Allen opening 62. As can be seen as the screw enters bore 28 it will draw the weight 30 and collar 44 against the stop flange 22 and lock them in place.

Once the locking-holding means or collar 44 is in place auxiliary disk weights 64, 64' or 64" may be inserted. In the preferred embodiment the inventor, when utilizing a dumbbell for one hand exercising, envisions several different disk weights, such but not limited to weights of 2.5, 5, 7.5, 10 and 12.5 pound increments. Such variations will allow a weight lifter or person exercising for therapy to customize the weights to be lifted.

In FIG. 1 there is shown three sizes and poundage of auxiliary disk weights 64 that may be used to accomplish the desired weight for lifting. In other words the person could start with the dumbbell 10 of FIG. 1 and add the increased auxiliary weights 64 to the desired amount.

With the present invention, the adjustment of weight or the dumbbell or barbell 12 can be interchanged or added with relative ease.

The collar 44 is externally threaded, as best seen in FIGS. 1 and 2.

The auxiliary disk weights 64, etc. are generally of the same configuration as weights 30 except their diameters are different depending upon the specific pounds of each disk weights 64.

The weights 64, 64' etc. each include a central thread bore 66 that extends inward from face 68, but does not extend through the thickness of the disk 64. The bore terminates in an end wall 70. Preferably the bore 66 is fitted with a lock washer 72.

In order to attach auxiliary disk weights 64, 64 or 64" or other weights, it is threaded onto the threaded collar 44 and is cinched up against the washer 58 to assure a tight fit that will not easily be dislodged. The weights 64 are placed on both ends and a new weight reading is available for body building or therapy.

It should be noted that if the exercise device 10 is a barbell then the central bar 12 would be longer and the disk weights could vary in poundage and dimension. However, the same principle is available for customizing the weights thereof as with a dumbbell.

With the auxiliary weights 64' etc. having limited entrance onto the collar 44, it will not protrude from the auxiliary disk weights outer face 72, see FIG. 2 to injure anyone that might hit the auxiliary disk weight 64.

In addition, each of the disk weights 64, 64', 64" may have bores 74 for hanging the disk weights on a rack (not shown) when not in use.

Further, in order to protect the disk weights 30 and 64 or any of the outer auxiliary weights 64, etc. and to help deaden the sound if dropped, they may be coated with latex rubber or other plastic substances.

The invention and its attendant advantages will be understood from the foregoing description and it will be apparent that various changes may be made in the form, construction and arrangements of the parts without departing from the spirit and scope thereof or sacrificing its material advantages, arrangements herein before described being merely by way of example. I do not wish to be restricted to the specific forms shown or uses mentioned, except as defined in the accompanying claims, wherein various portions have been separated for clarity of reading and not for emphasis.

I claim:

1. In an adjustable weight exercise device for body building and therapy for use in strengthening hands, arms, chest and the neck of a person using the same, said device including a central annular bar having a pair of ends and each end including weight stop means and projecting outwardly beyond said stop means each end having weight receiving shank portions, and a pair of annular disk weight members having exterior and interior surfaces and each mounted on one of said shank portions all on a common central horizontal axis and with said interior surface abutting said stop means, the improvement including:

weight locking-holding means affixed to the exterior surface of each of said weights to hold said weights to said central annular bar, and a pair of auxiliary disk weight extensions projecting outward from said exterior surface of each of said weights and on said common central horizontal axis;

a pair of auxiliary annular disk weights each having an exterior and interior surface and a diameter and each adapted to be releasably secured to each of said weight extensions, each of said auxiliary annular disk weights including a recess in said interior surface adapted to fit on said weight extensions and be maintained on said common central horizontal axis thereon until manually removed, whereby the total weights of said exercise device may be varied.

2. In an adjustable weight exercise device as defined in claim 1, wherein;

said exercise device is a dumbbell.

3. In an adjustable weight exercise device as defined in claim 2 wherein;

said weight locking-holding means includes a set screw passing through said auxiliary disk weight extensions, said disk weights, and into said shank of said central annular bar and said shank is threaded to receive said set screw.

4. In an adjustable weight exercise device as defined in claim 3 wherein;

each of said weight extensions is an exteriorly threaded collar.

5. In an adjustable weight exercise device as defined in claim 4 wherein;

each of said auxiliary annular disk weight recesses is threaded and may be threaded on said extension for securement to increase the total weight of said device.

6. In an adjustable weight exercise device as defined in claim 5 wherein;

each said recess has a stop wall and the recess is fitted with a lock washer against each said stop wall to assist in securely holding each of said auxiliary weights from inadvertent dislodgement, yet allowing removal and replacement.

7. In an adjustable weight exercise device as defined in claim 1, wherein;

said exercise device is a barbell and said central annular bar is elongated a distance of more than said diameter of said annular disk weight members.

8. In an adjustable weight exercise device as defined in claim 1, wherein;

said pairs of auxiliary annular weights includes pairs of different weight whereby the total weight of said device may be customized to a particular individual's needs.

9. In a dumbbell for body building or therapy, a central annular bar having a pair of ends and each end including weight stop means and each end having a weight receiving shank portion, and a pair of annular disk weight members with exterior and interior surfaces and a central bore therethrough, each of said weights being mounted on said shanks through said central bores and abutting said stop means, the improvement including;

a lock and auxiliary weight receiving collar abutting the exterior of each of said disk weights with a set screw passing through said collar and said weight into said bar to lock said weight in place, said collar including an exterior annular threaded surface projecting outwardly from said weights;

a pair of auxiliary annular disk weights each having an exterior and interior surface and including a centrally positioned threaded recess projecting inwardly from said interior surface and terminating before said exterior surface, each of said auxiliary annular disk weights releasably fitted on each of said collars by said threaded recess, whereby the total weight of said dumbbell may be varied.

10. In a dumbbell as defined in claim 9 wherein;

a lock washer is positioned between each of said annular disk weights to maintain said auxiliary annular disk weights against inadvertent dislodgement.

11. In a dumbbell as defined in claim 10 wherein;

said collar includes an annular bore therethrough, an interior chamber to receive the head of said set screw which when the screw finally tightened, said head is recessed within said bore.

* * * * *